United States Patent [19]

Frederick

[11] 4,044,508

[45] Aug. 30, 1977

[54] ADJUSTABLE HONING TEMPLATE

[76] Inventor: Richard Frederick, 1560 Dennison, Dundee, Mich. 48131

[21] Appl. No.: 671,007

[22] Filed: Mar. 26, 1976

[51] Int. Cl.[2] ..... B24B 5/00

[52] U.S. Cl. ..... 51/165.93; 51/34 A; 51/339; 408/11; 408/157

[58] Field of Search ..... 51/338–354, 51/165.87, 34 R, 34 A, 34 H–34 K, 165.93; 408/11, 13, 157, 158

[56] References Cited

U.S. PATENT DOCUMENTS

| | | | |
|---|---|---|---|
| 1,576,788 | 3/1926 | Restel | 51/344 |
| 1,876,468 | 9/1932 | Quigley | 51/344 |
| 1,981,258 | 11/1934 | Wagner | 51/347 |
| 2,102,053 | 12/1937 | Batzer | 51/346 |
| 2,308,356 | 1/1943 | Connor | 51/165.93 |
| 2,455,065 | 11/1948 | Keller | 51/341 |
| 2,608,034 | 8/1952 | Fromson | 51/341 |
| 2,825,189 | 3/1958 | Yerby | 51/352 |
| 2,991,597 | 7/1961 | Calvert | 51/346 X |
| 3,190,151 | 6/1965 | Kozacka | 408/11 |
| 3,702,043 | 11/1972 | Welbourn | 51/165.93 X |

*Primary Examiner*—Gary L. Smith
*Attorney, Agent, or Firm*—W. Preston Hickey

[57] ABSTRACT

A honing template comprising longitudinally extending fingers adapted to surround a hone and the ends of which carry template segments having inner abutment surfaces that are spaced to abut non abrasive surfaces that are in line with the stones when the stones are expanded to the finished diameter of the cylinder being honed. The inner abutment surfaces of the segments have a radius at least as great as the maximum radius of the cylindrical surface to be honed. The fingers have a tapered surface that is abutted by an annular ring which is wedged over said tapered surfaces to adjust the radial position of the template segments.

16 Claims, 13 Drawing Figures

ADJUSTABLE HONING TEMPLATE

BACKGROUND OF THE INVENTION

The present invention relates to an adjustable template and more particularly to an adjustable honing template for limiting the diameter of holes made by automatic honing machines and the like.

In at least one type of automatic machine that is used for honing cylindrical parts to a diameter that is accurate within one or two ten thousandths of an inch, the honing stones are cemented into recesses in metallic or plastic stone holders that have a non-abrasive surface at the upper end of the stone and which is aligned with the abrading surface of the stone. The stone holders are long and narrow and are received in longitudinally extending slots in the sidewalls of a tubular tool body. The inside of the stone holders are tapered upwardly and outwardly and are engaged by a downwardly extending cone fixed to the bottom end of a cone rod that extends upwardly and outwardly of the tool body. A plurality of the stone holders are positioned in slots evenly spaced around the tool body. The stones are moved outwardly against the work by forcing the cone rod downwardly to cause the cone to wedge the stones outwardly. Hydraulic means is provided for moving the cone downwardly to move the stones outwardly by a predetermined amount, whereupon the cone is locked into position. This outwardly predetermined amount is usually adjusted to bring the stones adjacent the surface of the work piece. Thereafter other hydraulic means slowly feeds the cone rod downwardly while the tool is rotating to remove a few thousandths of an inch from the work. An annular template or gauge ring is positioned adjacent the upper end of the work piece in which the cylinder is being honed. The automatic machine reciprocates the tool body axially upwardly and downwardly and at the end of each upward stroke the upper end of the stone holders move into the template or gauge ring. The template or gauge ring is loosely supported, and when the stones have enlarged the cylinder diameter in the work to that of the gauge ring, the stone holders come in contact with the surface of the gauge ring to produce a torque thereon. The torque is sensed by a limit switch which causes the machine to retract the cone rod and withdraw the honing tool out of the work piece. Liquid coolant flushes particles of abrasive and metal over the surfaces of the gauge and ever since the art of honing was first developed, solid rings of a very hard material have been used to resist the abrasion. The gauge rings, even when made of the hardest available commercial materials, do not last for the honing of more than six thousand work pieces in some cases. Honing operations are usually the final operation before assembly. Any imbalance of forces during honing may produce chatter and chatter usually causes the stones to dig into the finished surfaces to ruin the parts. The experience of the honing art has been that any crack or discontinuity in the template has ruined the parts produced, and consequently there has been a firm belief that the template must be continuous and solid.

An object of the present invention is the provision of a new and improved gauge ring or template which will greatly reduce the expense incurred by the frequent replacement of hardened gauge rings.

Further objects and advantages of the invention will become apparent to those skilled in the art to which the invention relates from the following description of several preferred embodiments that are described with reference to the accompanying drawings forming a part of the specification.

DESCRIPTION OF THE PREFERRED EMBODIMENT

Figure 3:
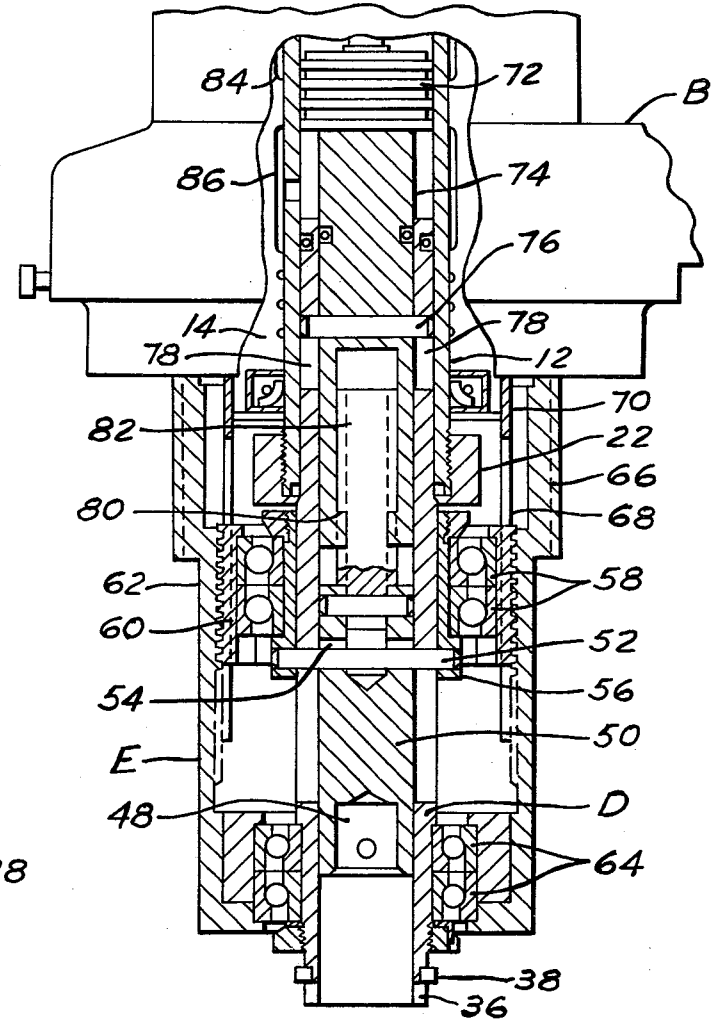
FIG. 3 is a fragmentary elevational view, with portions shown in section, of the structure that is connected to the lower end of the quill shown in FIG. 2.
Figure 2:
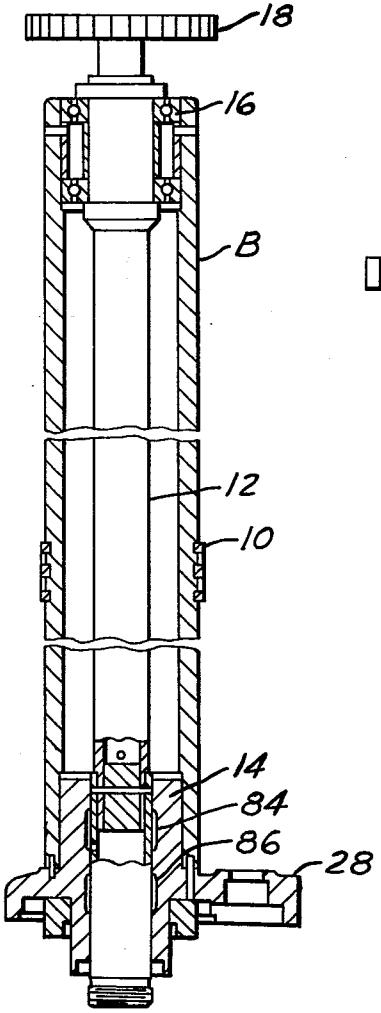
FIG. 2 is a longitudinal sectional view of the quill of the machine shown in FIG. 1.
Figure 1:
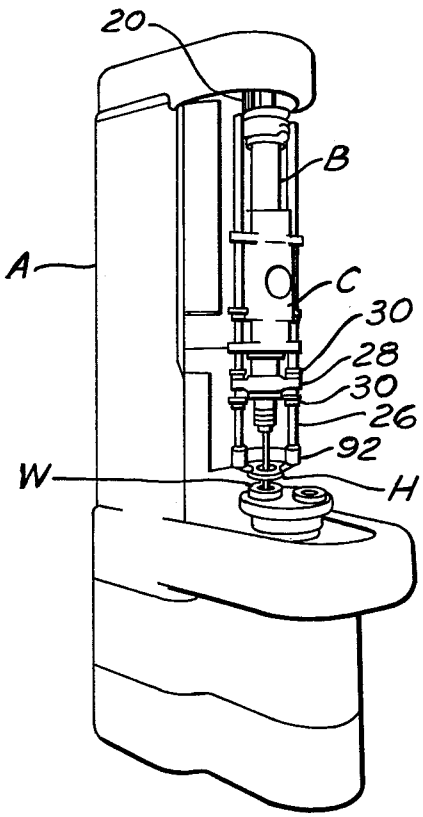
FIG. 1 is an isometric view of an automatic honing machine embodying principles of the present invention.

The honing art has long known that any slight chatter or seizure of the hone will cause the stones to either dig into the surface being finished to ruin its surface, or will break the stones, or both.

Since the art of honing was first developed, therefore, accurate honing diameters have been made, either by cut and try methods, or have been made by causing the stones to move outwardly until they engage a continuous hardened ring that is used as a template of the exact diameter desired. It has been feared that any discontinuity of the template would produce uneven forces, vibration and chatter, just at the time when the surface was approaching its final diameter and finish.

According to principles of the present invention, it has been discovered that a honing template or gauge need not be a continuous surface provided that the arc of the segments which make up the template have radii that are at least as great as the largest radius which the template will be used to make, and providing further that the segments are held in such a manner that they will not vibrate or chatter. These discoveries have made it possible to produce a structure which will last at least 100 times longer than the expensive hardened, continuous rings which last only for a few thousand parts.

Although the invention may be otherwise embodied it is herein shown and described as embodied in an automatic honing machine for finishing cylinders for internal combustion engines, pumps, compressors and the like.

The automatic honing machine shown in the drawing, generally comprises a cast iron frame A having a vertical cylindrical quill B which is reciprically mounted in the cylinder of the quill housing C. Suitable guide bushings and seals not shown are provided in the upper and lower ends of the quill housing C to provide a pressure chamber surrounding the quill B. The quill B is provided with piston rings 10 in its outer periphery for effecting a seal with the cylinder of the quill housing C, and hydraulic pressure is communicated to the cylinder above and below the piston rings to effect reciprocation of the quill B. The quill B in turn reciprocates the hone relative to the work as will later be described. A tubular drive shaft 12 is journaled in the quill B by a sleeve bearing 14 at its lower end and by suitable antifriction bearings 16 at its upper end. The upper end of the tubular drive shaft 12 is driven by a gear 18 that meshes with other gearing, not shown which other gearing slides along a vertical spline shaft 20 that is driven by a transmission located in the upper end of the frame A.

Figure 4:
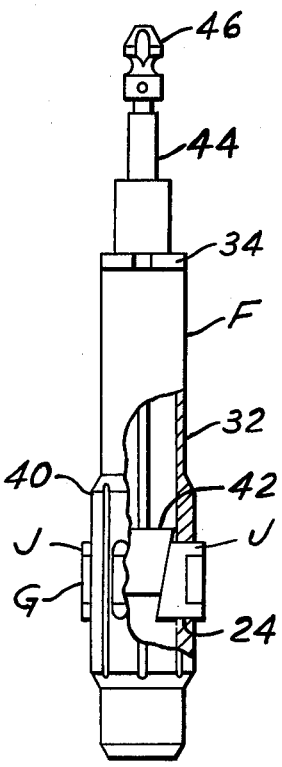
FIG. 4 is an elevational view, with a portion broken away, of a honing tool that is used by attaching it to the bottom end of the structure shown in FIG. 3.
Figure 5:
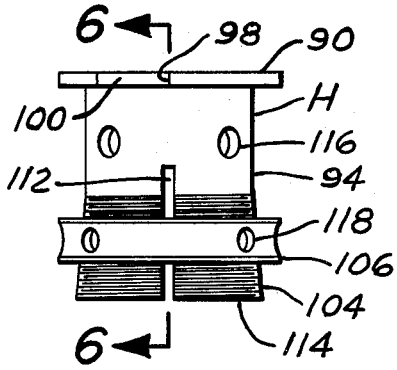
FIG. 5 is a side elevational view of an improved honing template, or gauge ring, that is used in the machine shown in FIG. 1, and which embodies principles of the present invention.
Figure 6:
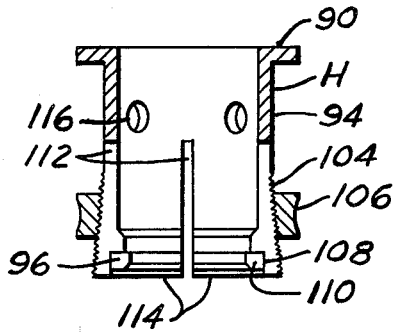
FIG. 6 is a sectional view taken approximately on the line 6—6 of FIG. 5.
Figure 7:
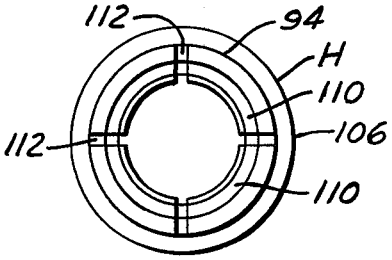
FIG. 7 is a bottom view of the template or gauge ring shown in FIG. 5.
Figure 8:
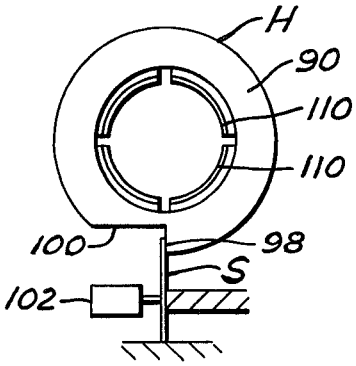
FIG. 8 is a plan view of the gauge ring shown in FIG. 5 to which a torque sensing spring and limit switch has been added-the function of which is to stop the honing operation and recycle the machine.

The upper end of a tubular drive shaft extension, or spindle D is telescoped up into the bottom end of the tubular drive shaft 12 and is frictionally coupled to the drive shaft 12 by a gland nut 22 and associated packing. The drive shaft extension D is journaled in an adjusting sleeve E that is axially retained and journaled in the bottom end of the quill B by structure not shown. The upper end of the honing tool F shown in FIG. 4 is received in the bottom end of the drive shaft extension D. Abrasive stones G are retained in vertical slots in the bottom end of the honing tool F in such manner that they can be radially positioned relative to the work, as will later be described. The honing tool F projects through the new and improved template or gauge ring H. The gauge ring H is supported by two guide rods 26 which pass through ears 28 in the bottom of the quill B and the upper ends of which are suitably guided by the quill housing G. Adjustable stops 30 are positioned on the guide rods 26 above and below the ears 39 so that when the quill B is moved downwardly, the gauge ring H is positioned immediately above the work W when the honing tool F is in its lower limit of travel. The template H stays adjacent the top of the work W while the honing tool F is reciprocated longitudinally of the work. When honing is completed and the honing tool F is withdrawn, the ears 28 engage the upper adjustable stops 30 and lift the template H clear of the work along with the honing tool F. During honing of the work, the abrasive stones G are moved slowly outwardly until plastic tabs on the upper ends of the stones G engage the template H. The structure for expanding the stones radially is quite elaborate and will now be described in detail.

The honing tool F comprises a tubular body 32 having a generally rectangular driving flange 34 that is received in a transverse slot 36 in the bottom end of the drive shaft extension D. A snap ring 38 is located just above the transverse slot 36, and a two piece nut, not shown is used to clamp the flange 34 to the end of the drive shaft extension D. The tubular body 32 contains an enlarged cylindrical portion 40 adjacent its lower end which cylindrical portion 40 contains the vertical slots 24 in which the stones G are located. The stones G are embeded in a hard plastic which forms the tabs J, and the inner surface of which is tapered longitudinally thereof for sliding engagement by a cone 42. The cone 42 is fixed to the lower end of a cone rod 44 which projects upwardly out of the tubular body 32 and is fastened to a cone spool 46. The cone spool 46 is received in a socket 48 in the bottom end of an adjustment plug 50 that is located in the bottom end of the drive shaft extension D.

As previously indicated mechanism capable of expanding the hone with two types of movement is provided. The first of these two types of expansion occurs when the hone is placed in the work, and is used to expand the hones outwardly by a predetermined amount designed to bring the stones into engagement with the work surfaces. The second of these movements is a slow continuous feeding movement that occurs throughout the honing cycle. A transverse pin 52 extends through a pair of bayonet slots 54 in the adjustment plug 50 with the outer ends of the pin 52 being received in a tubular inner race support 56 for a pair of antifriction bearings 58. The antifriction bearings 58 are received in a bearing retainer 60, the outer cylindrical surface of which has threaded engagement with the internal surfaces of a tubular adjusting sleeve 62. The upper end of the tubular adjusting sleeve is journaled and retained against endwise movement by the end of the quill B. The bottom of the tubular adjustment sleeve 62 is provided with a pair of thrust bearings 64 for journaling and holding the drive shaft extension D against endwise movement. The upper end of the tubular adjustment sleeve 62 is provided with gear teeth 66 for engagement by the rack of a hydraulic piston that is slowly moved to provide the second or hone feeding type of movement. Four longitudinal slots are milled beneath the threads of the tubular bearing retainer 60 and each receives a longitudinally extending finger 68 that is an intergal part of a sleeve 70 which is fixed to the bottom end of the quill, and by means of which the tubular bearing retainer 60 is held against rotation.

The first described hone expansion movement is initiated by the hydraulic piston 72 located in the bottom end of the tubular drive shaft 12. The piston 72 has an integral piston rod 74 which carries a short transverse pin 76, the outer ends of which are received in diagonally extending slots 78 in the upper end of the drive shaft extension D. The purpose of the angular slots 78 is to provide approximately 20° of counterclockwise rotation to the piston rod 74 as it moves downwardly. The bottom end of the piston rod 74 is drilled and splined as at 80 for receiving a splined plug 82 that is in turn rigidly fixed by a pin to the top end of the adjustment plug 50. By this arrangement only the counterclockwise rotation of the piston rod 74, as produced by the pin 76, is transferred to the adjustment plug 50, and this counterclockwise rotation causes the adjustment plug 50 to move counterclockwise and then downwardly approximately ¼ inch relative to the pin 52, as the pin 52 rides along the horizontal locking portion of the bayonet slots 54. The hone is thereby quickly expanded by a predetermined amount designed to bring the stones into engagement with the work. Pressure for expanding the hone is communicated to the annular groove 84 and pressure for collapsing the hone is communicated to the bottom annular groove 86 in the sleeve bearing 14.

The quill B is recriprocated between limits set to cause the stones G to extend slightly outwardly of the cylindrical surface being honed at the upper end of hone travel to bring the tabs J into the bottom of the gauge ring H. The gauge ring H has an upper flange 90 by which it is loosely supported from a bracket 92 that is fixed to the bottom of the guide rods 26. The main body portion 94 of the gauge ring H is generally cylindrically shaped. The bottom of the cylindrical body 94 is provided with a hardened template 96 which is engaged by the tabs J when the hole in the work has been honed to the proper diameter. Friction of the tabs J on the hardened surface 96 produces torque on the gauge ring H which is opposed by a spring S that abuts the radial surface 98 of notch 100. When the torque produced by the tabs J on the template surface 96 exceeds the initial tension of the spring, the spring moves and trips a micro switch 102 which initiates a cycle wherein withdrawal pressure is applied to the bottom annular groove 86 to raise the piston 72. The piston 72 in turn raises the adjustment plug 50 and causes the transverse pin 52 to slide along the bayonet slots 54 in the adjusting plug 50. This causes the cone 42 to move upwardly and collapse the stones G for withdrawal from the work.

Ever since the start of production honing to precise diameters, the art has always used a solid hardened ring as a template. Obviously any jerking, vibration or chatter etc. of the honing stones at the time that the honing operation approaches its final diameter, will cause the stones to dig into the surface and destroy the part being made. A lubricant is always played upon the stones during the honing operation and this lubricant washes loosened abrasive and metal particles over the template surface so that the template surface quickly wears out of tolerance. The art's solution to this problem has been to make both the template and tab from harder and harder materials with the result that the hardened template rings may cost $100.00 or more, and may be worn out of tolerance within 24 hours.

According to principles of the present invention, it has been discovered that the honed surfaces will not be damaged by using discontinuous template surfaces, so long as the template surfaces have a radius which is at least as large as the radius of the finished surface which it will be used to produce, and provided further that the segment of the template are supported in a sufficiently rigid manner that they will not vibrate when contacted by the moving tabs. It now appears that discontinuous segments do not excessively increase the wear of the tabs, and that the wear of the template surfaces occurs in a self correcting manner which prevents the tabs from being caught by discontinuous surfaces of the template.

In the embodiment of the gauge ring shown in FIGS. 5 through 8, the cylindrical body 94 is provided with a conical external surface adjacent the bottom thereof, which conical surface is threaded to receive internal threads of an adjustment ring 106. The bottom end of the cylindrical body is recessed as at 108 to receive a hardened ring 96, the internal cylindrical surface of which has been worn to a diameter greater than the maximum diameter to be produced by the honing operation. The hardened ring 96 is cemented into the recess 108 and four longitudinally extending slots 112 are cut upwardly from the bottom edge of the cylindrical body 94 through the ring 96 to a point above the conical surface 104. The ring 106 has a tight fit with respect to the small upper end of the conical surface 104 so that when the ring is threaded downwardly it biases the four fingers 114 formed by the slots 112, radially inwardly to decrease the radial position of the segments 110 of the hardened ring. Appreciable torque is required to turn the hardened ring over the threads of the conical surface 104, and accordingly holes 116 and 118 are provided in the body 94 and ring 106, respectively, to receive the pins of spanner wrenches. The outer surface of the ring 106 is grooved to receive its spanner wrench, and keep the spanner wrench from slipping sidewardly onto the threads of conical surface 104. The threads forming the conical surface 104 and the internal threads of ring 106 both have a taper of $\frac{3}{4}$ of 1°.

After the gauge ring has been assembled the distance between opposite ring segments 110 is accurately determined and the ring 106 is turned down until the diameter is less than that desired in the finished work. The gauge ring H is installed in the honing machine, and the machine is run through a cycle to produce a finished part. The finished part is checked for diameter, preferably with an air gauge, and the ring 106 is backed off until the honed surfaces in the work piece just meet the minimum desired diameter. The machine is then used in production and the diameter of the parts produced is checked to see that they are within tolerance. During use, the tabs J, stones G and the ring segments 110 will change diameter and these changes can be compensated for by periodically rotating the ring 106 a few degrees relative to the cylindrical body 94. Whenever the operator determines that the diameter in the work piece is approaching the upper limit of tolerance, the ring 106 is turned downwardly a few degrees. Experience quickly indicates the number of ten thousandths of an inch decrease in the work piece that is produced by a given increment of rotation of the ring 106. It has been found that gauge rings of the type shown in FIGS. 5 through 8 can be used to produce over 500,000 parts whereas solid template rings have to be discarded after producing approximately 30,000 parts. A savings of over $100.00 a day per honing machine, therefore can be realized by using the adjustable gauge rings of the present invention.

Figure 9:
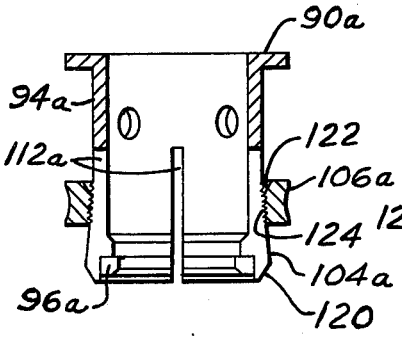
FIG. 9 is a sectional view similar to FIG. 6 but showing another embodiment of the invention.

The embodiment of gauge ring shown in FIG. 9 corresponds generally to that shown in FIGS. 5 through 8 but differs principally therefrom in that only the internal surface of the adjustment ring is threaded, while the external tapered surface of the body is not. Those portions of the embodiment shown in FIG. 9 which correspond to similar portions of the embodiment shown in FIGS. 5 through 8 are designated by a like reference numeral, characterized further in that a suffix *a* is affixed thereto. The fingers 114*a* have an upper tapered surface 104*a* and a lower tapered surface 120. The ring 106*a* has an upper internal surface 122 which matches the surface 120 and a lower tapered threaded surface 124 the taper of which matches the taper of the surface 104*a.* The threads of the ring 106*a* are harder than is the body 94*a.* When the ring 106*a* is forced upwardly over the end of the fingers, the fingers are moved radially inwardly. Rotation of the ring 106*a* causes the threaded surface 124 to move over the apex and thereafter cut shallow threads into the surface 104*a* of the fingers.

Figure 10:
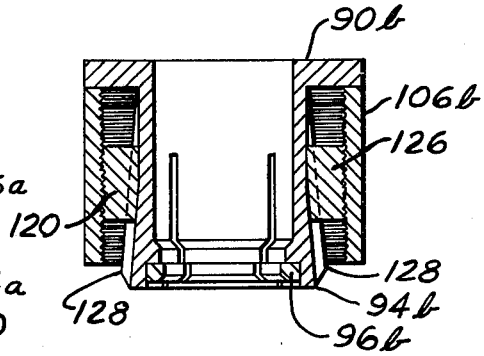
FIG. 10 is a sectional view similar to FIGS. 6 and 9 but showing still another embodiment of the invention.

The embodiment shown in FIG. 10 corresponds generally to the embodiment shown in FIGS. 5 through 8 but differs principally therefrom in that the external surface of the projecting fingers of the cylindrical body have grooves therein in which are positioned camming segments that are advanced by a ring having cylindrical internal threads. Those portions of the embodiment shown in FIG. 10 which correspond to similar portions of the embodiment shown in FIGS. 5 through 8 are designated by a like reference numeral characterized further in that a suffix *b* is affixed thereto. The camming segments are designated by the numeral 126 and the longitudinally extending grooves in which they are located are designated by the numeral 128. The unit is assembled by sliding the camming segments 126 to the upper end of the grooves 128 so that segments 126 are in their most collapsed condition. The ring **106*b* is slipped down over the end of the body member 94*b* to cause the internal threads of the ring 106*b* to engage the threads of the segments 126. Thereafter the ring 106*b* is threaded axially until it abuts the flange 90*b*, following which further rotation of the ring 106*b* will advance the segments 126 downwardly along the grooves 128** to cam the fingers radially inwardly.

Figure 11:
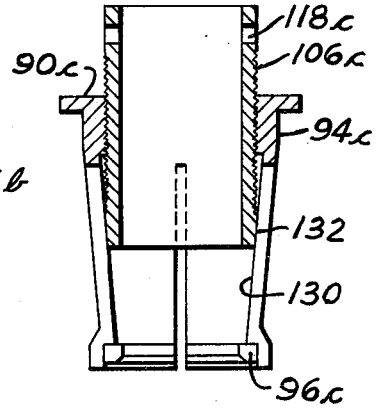
FIG. 11 is a sectional view similar to FIGS. 6, 9 and 10 but showing still another embodiment of the present invention.

The embodiment shown in FIG. 11 corresponds generally to that shown in FIGS. 5 through 8 but differs principally therefrom in that the camming surfaces are in the inside of the fingers of the gauge body to force and hold the fingers outwardly against the spring action of the fingers. Those portions of the embodiment shown in FIG. 11 which correspond to similar portions of the embodiment shown in FIGS. 5 through 8 are designated by a like reference numeral characterized further in that a suffix *c* is affixed thereto. The internal camming surface of the fingers of the body **94*c* are designated by the reference numeral 130, and the camming surface of the ring 106*c* is designated by the numeral 132. The segments 96*c* have an internal radius corresponding to that of their position when the fingers are in their outermost position. The ring 106*c* is threaded downwardly until the segments 96*c* define the proper diameter. Thereafter the ring 106*c* is rotated counter clockwise to move the ring 106*c*** upwardly when it is desired to compensate for wear.

Figure 12:
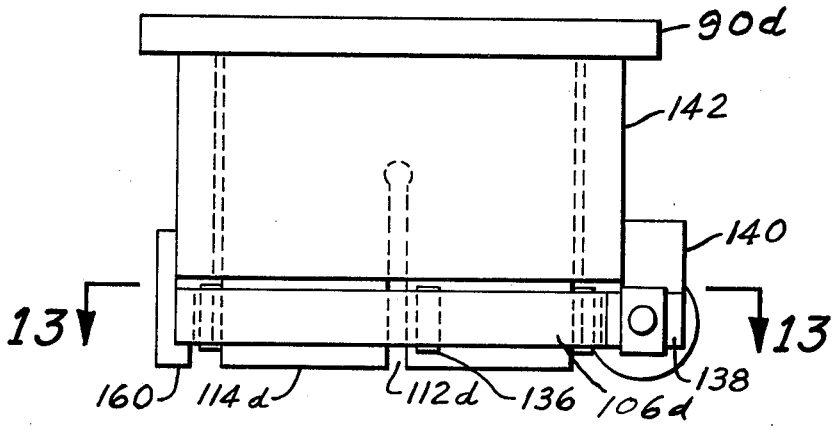
FIG. 12 is a side view of another embodiment of the invention.
Figure 13:
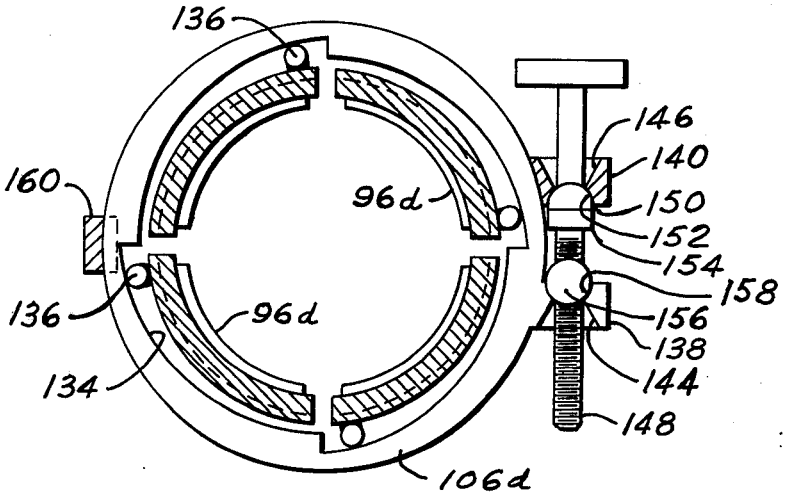
FIG. 13 is a sectional view taken approximately on line 13—13 of FIG. 12.

The embodiment shown in FIGS. 12 and 13 differs from those previously described principally in that the camming surfaces are disposed circumferentially of the fingers, and that a slight twisting action of the fingers as well as a radial deflection of the fingers is produced by the circumferential camming action. Those portions of the embodiment shown in FIGS. 12 and 13 which correspond to similar portions of the embodiments previously described are designated by a like reference numeral characterized further in that a suffix *d* is affixed thereto. The ring **106*d* is broached to provide four circumferentially extending camming surfaces 134, each being constructed and arranged to overlie one of the fingers 114*d*. Respective short rods 136 are welded to the outside of respective fingers adjacent to their trailing edges as determined by hone rotation for engagement by the camming surfaces 134.**

The ring **106*d* may be turned in several different ways to cam the fingers 114*d* inwardly. In the embodiment shown, an abutment 138 is welded to the outside surface of the ring 106*d* and an opposing abutment 140 is welded to the outside of a sleeve 142 which has clearance with respect to the fingers 114*d*. The upper end of the sleeve 142 is welded to the bottom of the upper flange 90*d*. The abutments 138 and 140 have respective tapered openings 144 and 146 therethrough to receive a lead screw 148. The lead screw 148 extends through an opening in a semicylinder 150 that is seated in a cylindrically shaped socket 152 in the face of the abutment 140. A collar 154 is fixed to the lead screw 148 for abutment against the flat face of the semicylinder 150. A short rod 156 is drilled and tapped to receive the lead screw 148, and is positioned in a socket 158 in the face of abutment 138. By rotating the lead screw 148, therefore, the ring 110*d* is turned clockwise as seen in FIG. 13 to cam the trailing edges of the fingers radially inwardly. An L-shaped bracket 160 is welded to the opposite side of the sleeve 142 with its horizontal leg positioned beneath the ring 106*d*** so that both sides of the ring are supported.

When the lead screw 148 is rotated clockwise the abutments 138 and 140 are forced apart and the ring **106*d* is turned. The camming surfaces 134 ride over the rods 136 to move the fingers 114*d* inwardly. Because the fingers are located adjacent the trailing edge of the fingers 114*d*, the trailing edge of the fingers is moved inwardly to a greater degree than is their leading edge. The trailing edges of the segments 110*d* are the only portions contacted by the tabs of the hone and this prevents them from catching on the leading edge of the template segments 110*d*.**

It will be seen that since the fingers of all of the embodiments are only moved inwardly during use, that the radius of the surface of the segments is always greater than that defined by the segments and which is traveled by the tabs of the hone. It is therefore impossible for the tabs to catch upon the leading edge of the segments.

It will now be apparent that the objects heretofore enumerated as well as other have been accomplished, and that there has been provided a new and improved adjustable honing template having discontinuous template segments which can be adjusted diameterwise, and which do not produce destructive chatter of the stones when the tabs of the stones slid over the template segments.

While the invention has been described in considerable detail, I do not wish to be limited to the particular embodiments shown and described, and it is my intention to cover hereby, all adaptations, modifications, and arrangements thereof which come within the practice of those skilled in the art to which the invention relates.

I claim:

1. In a machine for increasing the diameter of holes in metals, and the like, having a spindle with a longitudinally extending axis of rotation and material removing elements which expand radially outwardly to increase the diameter of the hole, an improved diameter limiting device, comprising:

a plurality of template segments for engagement by said material removing elements, an annular holder having an axially extending opening therethrough for receiving the spindle of the machine, said annular holder having generally exially extending fingers respective ones of which support respective ones of said template segments, a camming ring concentric with said fingers, said fingers having abutment surfaces thereon which are moved radially upon rotation of said camming ring, and torque sensing means for sensing the torque exerted on said template segments by said material removing elements, and whereby the torque sensing means can be utilized to indicate that the hole in the work has been enlarged to a predetermined diameter.

2. The diameter limiting device of claim 1 wherein said fingers have external threads thereon and said annular ring has internal threads which engage said external threads of said fingers, and whereby rotation of said annular ring moves said annular ring longitudinally of said fingers to adjust the position of said template segments.

3. The device of claim 2 wherein said fingers and ring are tapered longitudinally with respect to each other and rotation of said ring causes it to move longitudinally of said fingers.

4. The device of claim 3 wherein said fingers are tapered outwardly and said annular ring has a taper which matches the taper of said fingers.

5. The device of claim 4 wherein said tapers are at an angle of approximately ¾ of 1° relative to said longitudinally extending axis.

6. The device of claim 2 wherein said holder has a radially extending opening therein positioned to one side of said external threads for receiving a spanner wrench, said annular ring having a circumferentially extending groove in its outer surface, and a radially extending hole in said groove for receiving a spanner wrench.

7. An adjustable honing template for limiting the radially outward movement of honing elements, said template comprising: a generaly tubular body having upper and lower ends and an axially extending opening therethrough, said body having a plurality of longitudinally extending fingers, said fingers having conically shaped external surfaces, a ring surrounding and abutting said conically shaped external surfaces, said ring and body having threaded engagement for positioning said ring longitudinally of said conically shaped external surfaces, and template segments carried by said fingers for abutment by the honing elements, and whereby rotation of said ring moves said template segments radially to adjust the limit of radially outward movement of the honing elements.

8. The adjustable honing template of claim 7 wherein said conically shaped external surface decrease in diameter as they approach the upper end of said tubular body.

9. The adjustable honing template of claim 8 wherein said abutments have arcuate surfaces for abutment by the honing elements, and said arcuate surfaces define a circle in the at rest condition of said fingers.

10. An adjustable honing template for limiting the radially outward movement of honing elements, said template comprising: a generally tubular body having an external flange on its upper end, an axially extending opening therethrough, and a conically shaped external surface which tapers outwardly and downwardly, said conically shaped portion of said body having a plurality of slots therethrough which communicate with said lower end to provide a plurality of depending fingers, said conically shaped external surface being threaded, a ring surrounding said fingers and having threaded engagement with said conical surface, and hardened arcuately shaped abutments carried by said fingers with their arcuate surfaces positioned to limit radially outward movement of the honing elements, and whereby rotation of said ring moves said abutments radially to adjust the limit of radially outward movement of the honing elements.

11. An adjustable honing template for limiting the radially outward movement of honing elements, said template comprising: a generally tubular body having an external flange on its upper end, an axially extending opening therethrough and a double tapered external surface having an apex adjacent the lower end of said body with tapers above and below said apex, said body having a plurality of slots therethrough extending from the lower end of said body upwardly through said double tapered surfaces to provide a plurality of depending fingers having double tapers on their external surfaces, a ring having internal threads of a diameter to engage said double tapered surfaces, said ring being of a material hard enough to form threads in said tapered external surfaces of said fingers, and hardened arcuately shaped abutments carried by said fingers with their arcuate surfaces positioned to limit radially outward movement of the honing elements.

12. The adjustable template of claim 11 wherein said ring has a longitudinally extending internal surface which is tapered at its upper end to generally match the tapered surface of said fingers below said apex and which is threaded and tapered at its lower end at an angle generally matching the tapered surface of said fingers above said apex.

13. An adjustable honing template having adjustable longitudinally extending fingers comprising: a body member having generally parallel axially extending fingers projecting therefrom, said fingers having abutment surfaces which are tapered longitudinally thereof, a template segment on each of said fingers, a ring generally paralleling said fingers and having a threaded internal or external surface thereon, camming means having engagement with said tapered abutment surfaces of said fingers, and means constructed and arranged to transform rotation of said ring into longitudinal movement to said camming means along said tapered abutment surfaces of said fingers, and whereby the radial position of said template segments is adjusted by rotation of said ring.

14. The structure of claim 13 wherein said camming means comprises a plurality of wedges having inner surfaces which slide over tapered external surfaces of said fingers and having outer surfaces engaged and moved longitudinally by said threaded surface of said ring.

15. An adjustable honing template comprising: an annular body member having a longitudinally extending opening therethrough for receiving a hone, a plurality of generaly parallel fingers extending longitudinally of said annular body member, a template segment on each finger with said template segments defining a circle, a rigid adjustment ring positioned opposite said fingers, and a camming surface advanced over said fingers by rotation of said adjustment ring for wedging said fingers radially, and whereby the diameter of the circle defined by said template segments is changed by rotation of said adjustment ring.

16. The adjustable template of claim 15 wherein said fingers have an external abutment adjacent their trailing edges, and said adjustment ring has circumferentially extending camming surfaces which engage said abutments to cam the trailing edge of each finger inwardly upon rotation of said adjustment ring.

* * * * *